United States Patent [19]

Crush, Jr.

[11] 4,220,328

[45] Sep. 2, 1980

[54] PULLING LINE SPORT APPARATUS

[76] Inventor: Roy D. Crush, Jr., 4026 Kreinhop, Spring, Tex. 77379

[21] Appl. No.: 923,801

[22] Filed: Jul. 12, 1978

[51] Int. Cl.[2] ..... A63B 21/28

[52] U.S. Cl. ..... 272/116; 272/143

[58] Field of Search ..... 273/1; 272/116, 143, 272/DIG. 4, 109, 93

[56] References Cited

U.S. PATENT DOCUMENTS

| | | | |
|---|---|---|---|
| 2,884,248 | 4/1959 | Tenney | 273/1 R |
| 3,563,208 | 2/1971 | Nero | 273/1 R |

*Primary Examiner*—Richard C. Pinkham

*Assistant Examiner*—R. Carl Moy

*Attorney, Agent, or Firm*—Browning, Bushman & Zamecki

[57] ABSTRACT

The invention pertains to apparatus for playing tug-of-war and similar games. The apparatus comprises an elongate, flexible, generally inelastic pulling line having opposite terminal portions and a mid-portion interconnecting the terminal portions. A plurality of handle assemblies is secured to each of the terminal portions respectively. Each of the handle assemblies includes at least one handle body, preferably in the form of a loop of flexible, generally inelastic material, removably secured to the pulling line for independent swinging and swivelling movement with respect thereto.

13 Claims, 4 Drawing Figures

PULLING LINE SPORT APPARATUS

BACKGROUND OF THE INVENTION

1. Field of the Invention

The present invention pertains to apparatus for playing the game of tug-of-war and other similar games. As is well known, the game consists basically in the grasping of opposite end or terminal portions of a rope by respective teams of players, each team attempting to pull the opposing team forward across a fixed marker of some type. The game has numerous advantages, one of the most important of which is the fact that it exercises virtually every part of the player's body. The game also involves the various well known benefits of team sports in general, such as the fostering and development of a capacity for team work and cooperation in the players. Nevertheless, it does not require a large, expensive, or highly specialized playing field, as do many other team sports. Nor does it require highly specialized apparrel or equipment to be worn by the players themselves. These features, together with the relative simplicity of the actual playing equipment, make it highly economical. Finally, it is a game suitable for a wide variety of age groups.

2. Description of the Prior Art

Despite the many salient features of tug-of-war and similar games, as set forth above, it suffers from several disadvantages, most of which are caused by the relatively primitive equipment used, i.e. a length of rope. One such disadvantage is that the players' hands tend to slide along the rope during play resulting in discomfort and even injury. Even more serious consequences may result when the pulling line breaks causing one of the severed portions thereof to slide very rapidly through the players' hands. Such accidents have been known to cause loss of hands and digits as well as serious burns and lacerations. Although the rope may be knotted at spaced intervals to provide stops for the players' hands, this simple expedient does not completely solve the problem of injury should the rope break. Furthermore, the surface of the rope is typically still abrasive enough to cause considerable discomfort to the players.

Additionally in order to be easily knotted the rope must be of a relatively small diameter, which in turn makes it more difficult to grasp. Accordingly, a large diameter rope, even if it cannot be readily provided with knots to serve as stops for the players' hands, is frequently preferred, not only because it is easier to grasp than a small diameter rope, but also because it provides greater strength. However, large diameter ropes are, in turn, substantially heavier and stiffer. This makes them awkward to use and limits the versatility and strategy of movement which can be employed by the players during the game. Another factor which contributes to the latter disadvantages is the fact that the game is typically played with all players positioned on the same side of the rope.

SUMMARY OF THE INVENTION

The present invention provides an apparatus for use in tug-of-war and similar sports which, without substantially increasing the cost of the sport or negating its various salient features, substantially eliminates many of the disadvantages discussed above. The apparatus includes an elongate, flexible, generally inelastic pulling line having opposite terminal portions, adjacent which the players are positioned during the game, and a mid-portion interconnecting the terminal portions. A plurality of handle assemblies are secured to each of the terminal portions for grasping by respective ones of the players. These handle assemblies each of which preferably includes at least one closed loop, permit the players to get a firm, comfortable, non-slipping grip on the apparatus, thereby drastically reducing the possibility of severe rope burns and still worse injuries even if the pulling line were to break during play. This, in turn, makes the game more suitable for younger children, a group for which the game is otherwise particularly suited due to its simplicity and low cost.

In preferred forms of the invention, the handle assemblies at each terminal portion of the pulling line, i.e. the assemblies for each respective team, include a plurality of longitudinally inner assemblies secured alternately at opposite sides of the pulling line and an end assembly secured at the end edge of the respective terminal portion of the pulling line. This provides a more symmetrical distribution of the players of each team, one player known as the "anchor" being positioned directly behind the pulling line, and the other players being distributed half on each side of the pulling line.

Each of the handle assemblies preferably comprises two separated handle bodies, each in the form of a flexible generally inelastic loop. The two loops of each assembly are independently secured to the pulling line for independent swinging and swivelling movement with respect thereto. These features combine to provide a flexibility of movement previously unknown in tug-of-war and similar games. The flexibility not only enhances the comfort of the players, but also makes possible a much higher degree of versatility and strategy thereby rendering the game more interesting and challenging.

The handle assemblies are preferably releasably secured to the pulling line making them easily replaceable and/or repairable, permitting their removal for more compact and convenient storage of the equipment, and likewise permitting removal where the number of players is less than the maximum number of handle assemblies which may be accommodated by the pulling line. Alternatively, to increase the number of players, extension means, including auxiliary lines having respective auxiliary handles thereon, can be releasably securable to the connection means at the ends of the pulling line on which the end handle assemblies are ordinarily mounted.

In preferred forms of the invention, the pulling line as well as the loops or handle bodies of the handle assemblies are formed of a strong but lightweight woven fabric such as nylon. Such material can be easily stitched upon itself thus facilitating the mounting of the aforementioned handle assemblies in a manner which would be impossible with a relatively large diameter rope. Furthermore, the light weight and flexibility of this material increases the level of skill which may be developed in playing the game by enhancing the manueverability of the pulling line and permitting the players greater freedom of movement.

Accordingly, a principal object of the present invention is to provide an improved apparatus for playing tug-of-war and similar sports.

Another object of the present invention is provide tug-of-war apparatus having handles for gripping by the players.

A further object of the present invention is to provide such an apparatus which permits a higher degree of skill and strategy in the sport through greater freedom of movement.

Still another object of the present invention is to provide such an apparatus wherein the handle assemblies for respective players of a team are arranged so as to position said players more symmetrically about their respective terminal portions of the pulling line.

Yet another object of the invention is to provide a simple, economical tug-of-war apparatus which makes the sport substantially safer and more interesting without undue increase in the cost of the apparatus.

Still a further object of the present invention is to provide a tug-of-war apparatus comprised largely of extremely strong yet flexible and light weight fabric, the handle assemblies thereof being easily removable from the pulling line for easy storage of the apparatus.

Still other objects, features and advantages of the present invention will be made apparent by the following detailed description of a preferred embodiment, the accompanying drawings, and the claims.

DESCRIPTION OF THE PREFERRED EMBODIMENTS

Figure 4:
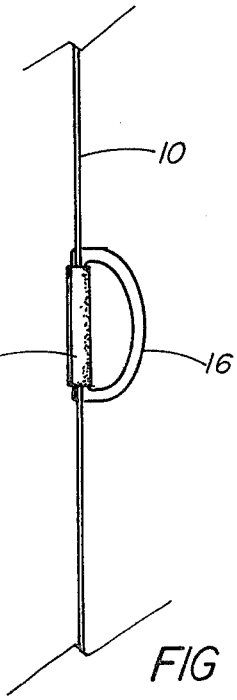
FIG. 4 is a side elevational view taken along the line 4—4 of FIG. 3.

Referring now to the drawings, there is shown an apparatus in accord with one preferred embodiment of the present invention. The apparatus includes an elongate, flexible, substantially inelastic pulling line 10, preferably comprised of a strong but lightweight material such as nylon. More specifically, line 10 is preferably comprised of a woven fabric of such material whereby it may be formed to have a substantial width, e.g. two or three inches, but as best seen in FIG. 4, a very small thickness, on the order of a small fraction of an inch. Consequently, line 10 has a generally flattened configuration (see again FIG. 4) which makes it easy to fold into a compact form for storage and also facilitates stitiching in the mounting of connection means thereon, as will be described hereinafter. It is noted that, as used herein, the term "inelastic" is used in a general, nontechnical sense. Thus the term is not intended to connote that the line 10 does not stretch somewhat in use, but only that it is sufficiently inelastic to permit its use in tug-of-war and like games in the well known manner.

FIG. 10 shows one end or terminal portion 10*a* of the pulling line 10 as well as part of the integral mid-portion 10*b*. Mid-portion 10*b* joins terminal portion 10*a* to an opposite and substantially identical end portion (not shown). Mid-portion 10*b* has a central marker 12 applied thereto in any suitable manner for convenience in observing movement of the pulling line 10 with respect to reference marks on the ground during play.

Terminal portion 10*a* of pulling line 10 has a plurality of handle assemblies secured thereto. These include a plurality of longitudinally inner handle assemblies, each including a pair of handle bodies 14. The inner handle assemblies are secured to pulling line 10 at positions spaced approximately equally longitudinally along line 10, adjacent ones of the handle assemblies being secured to line 10 at opposite lateral edges thereof. Additionally, an end handle assembly, comprising a pair of handle bodies 14' substantially identical to bodies 14, is secured to the end edge of portion 10*a* of line 10, and spaced from the next adjacent handle assembly by a distance substantially equal to that with which the longitudinally inner handle assemblies are spaced from one another.

Figure 1:
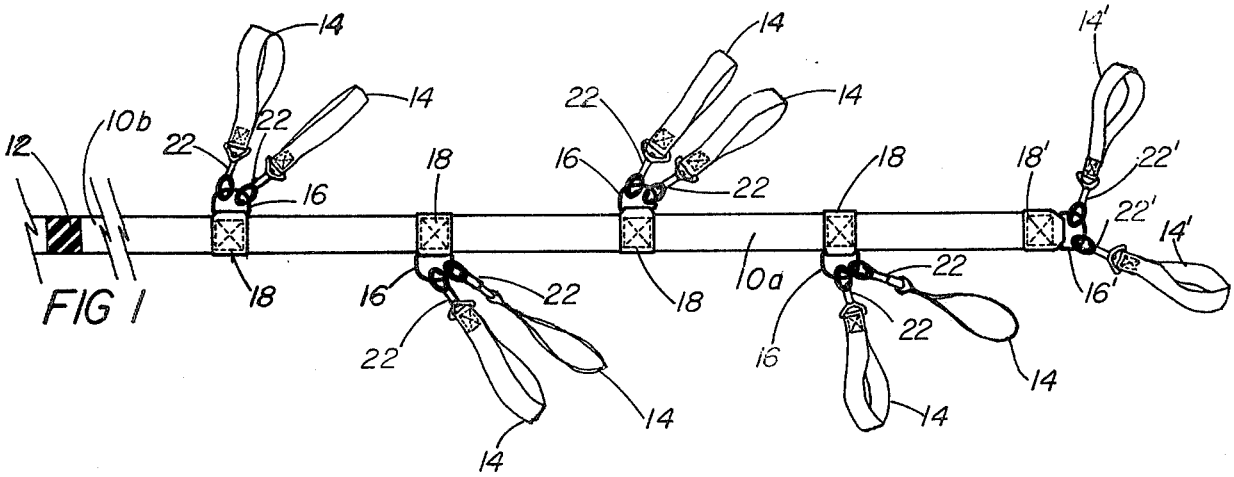
FIG. 1 is a partial top plan view of an apparatus according to the present invention.
Figure 3:
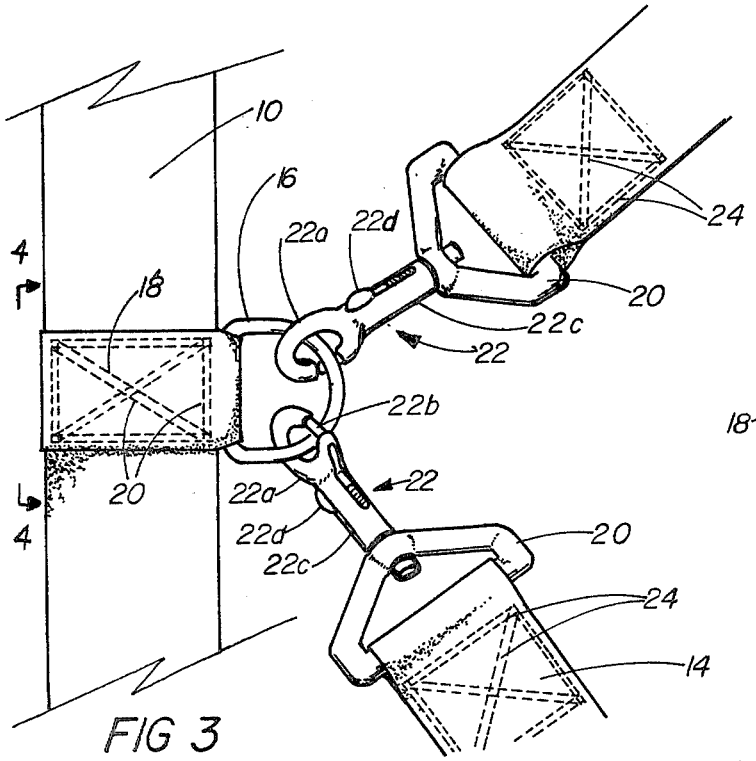
FIG. 3 is an enlarged plan view of the connection means of one handle assembly of the apparatus of FIGS. 1 and 2.

To mount the handle assemblies on the line 10, first connection means including side connectors in the form of D-rings 16 and end connectors in the form of D-rings, one of which is shown at 16', are secured to the terminal portions of line 10. Each ring 16 or 16' is positioned to properly mount a respective one of the handle assemblies. The side connectors or rings 16 which serve to mount the inner handle assemblies are positioned so that alternate ones of the rings 16 for each terminal portion of line 10 are disposed adjacent opposite lateral edges of line 10 as best shown in FIG. 1. As shown in FIG. 3, each ring 16 is secured to line 10 by a strip 18 of material similar to that of which line 10 is formed. Strip 18 is passed through the respective ring 16 and transversely around line 10. Strip 18 is then secured upon itself as well as to the line 10 by stitching 20 to firmly secure the respective rings 16 in the proper position on line 10.

A substantially identical end connector or D-ring 16' is similarly secured adjacent the end edge of each of the terminal portions of line 10 for mounting the respective end handle assembly. FIG. 1 shows the mounting of the ring 16' for terminal portion 10*a* by a strip of material 18' which passes through ring 16' and across the upper and lower surfaces of line 10 adjacent the end edge of portion 10*a*. Strip 18' is secured by stitching in substantially the same manner as strips 18.

Each of the handle assemblies includes second connection means for mounting that handle assembly on the respective one of the rings 16 or 16'. More specifically, each of the handle bodies 14 is in the form of a closed loop of material substantially identical to that of which line 10 is formed, each such loop 14 passing through a respective metal link 20. Each link 20 carries a hook assembly 22 by which the respective loop 14 is secured to ring 16.

Each of the hook assemblies 22 include a curved hoop portion 22*a*, a latch member 22*b*, and a shaft portion 22*c*. The latch member 22*b* is resiliently biased, by a spring carried by shaft portion 22*c*, to a position extending across the mouth of hook portion 22*a*, whereby hoop portion 22*a* and latch member 22*b* together form a closed link securing the hook assembly to the respective ring 16. In order to remove the hook assembly from the ring 16, latch member 22*b* may be retracted from the mouth of hook portion 22*a* by operation of a slide 22*d* in the well known manner.

The fact that each of the handle bodies or loops 14 of a given handle assembly is independently secured to the ring 16 by its own respective hook assembly 22 permits independent swinging movement of such handle bodies 14 with respect to the pulling line 10. Furthermore, the shaft portion 22*c* of each of the hook assemblies 22 is rotatably mounted in the respective link 20 to form a swivel mechanism in the well known manner. Thus each handle body 14 is permitted independent swivelling movement with respect to line 10. Additionally, each of the flexible loops 14 is stitched upon itself adjacent the respective link 20 as indicated at 24. Such stitching prevents lengthwise slipping of the loop 14 through the link 20 while still permitting relative pivotal movement between the loop and link. The freedom of movement provided by this combination of features permits each player to independently orient each of his hands in a large number of different positions with respect to pulling line 10 while still maintaining a firm but comfortable grip via the loop 14. This not only enhances the comfort of the player but also increases his manueverability thereby rendering the same simultaneously more strategic and challenging.

The handle bodies 14' of the end handle assembly are removably secured to ring 16' by hook assemblies 22'. Assemblies 22' are substantially identical to assemblies 22 and are mounted on loops 14' in virtually the same manner as assemblies 22 are mounted on loops 14.

Figure 2:
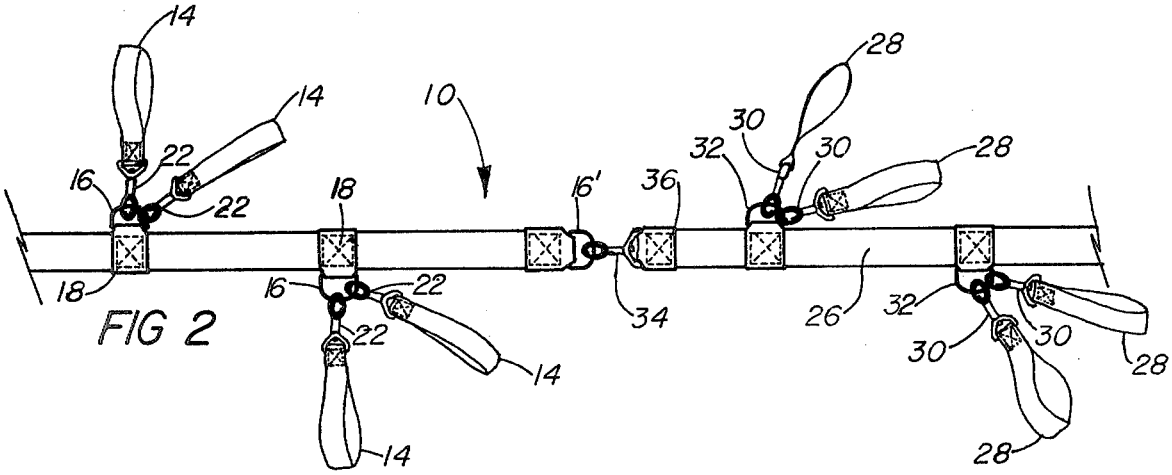
FIG. 2 is a partial top plan view of one end portion and an extension means of the apparatus.

The removability of handle bodies 14 and 14' permits easy storage, repair and/or replacement thereof. Furthermore, this feature allows unnecessary handle bodies to be removed when the apparatus is being used by less than the maximum number of players. To increase the number of players which may utilize the apparatus, the handle bodies 14' of the end handle assembly can either be swung toward one side of line 10 on ring 16' or can be removed. In either case, an extension means is removably secured to ring 16' as shown in FIG. 2. The extension means includes an auxiliary line 26 of the same material as line 10. The extension means further includes a plurality of handle assemblies each including a pair of handle bodies 28 substantially identical to bodies 14. Such auxiliary handle assemblies are mounted at alternating lateral edges of line 26 in substantially the same manner as bodies 14 are secured to pulling line 10, i.e. by hook assemblies 30 (identical to assemblies 22) carried by bodies 28, and D-rings 32 (identical to rings 16) carried by line 26 at longitudinally spaced locations. The extension means further includes a hook assembly 34, also identical to assemblies 22, and mounted on one end of line 26 by a strip 36 of flexible material passing through a link connected to assembly 34 and stitched to line 26. Thus, line 26 may be removably secured to ring 16' by hook assembly 34. The other end of line 26 may include an end handle assembly (not shown) substantially identical to that of the main pulling line 10 and mounted in like manner.

In addition to the flexibility of movement provided by the means of mounting the handle bodies on the pulling line, described hereinabove, the apparatus of the invention provides a more symmetrical disposition of the players on each team about their respective terminal portion of pulling line. In particular, one player, known as the "anchor," utilizes the end handle assembly including loops 14' and is positioned directly rearwardly of portion 10*a* of the pulling line. The remainder of the team is divided half on each side of portion 10*a* and with the players on one side thereof interspersed between the players on the other side. Such orientation not only enhances the team's pulling ability, but permits a greater number of players to be used along a given length of pulling line without interfering with one another's movements.

The use of the handles 14 and 14' substantially eliminates any problem of rope burn or the like caused by the players' hands slipping along the pulling line. Furthermore, since line 10 need not be directly gripped by the players, it may be formed with the flattened configuration described hereinabove which facilitates easy and compact storage as well as the stitching of strips 18 and 18' to the pulling line 10. The flexible fabric of which handle bodies 14 and 14' and pulling line 10 are formed may be manufactured in bright colors thereby making the progress of the game more readily observable by fans as well as rendering the game more attractive and appealing, particularly to children.

Numerous modifications of the preferred embodiment described above may be made without departing from the spirit of the invention. By way of example only, various modifications could be made in the means of mounting the handle assemblies on the pulling line. Likewise, the handle bodies themselves could be altered, e.g. molded plastic handles might be used in lieu of flexible loops. In some forms of the invention, it might be desirable for each handle assembly to include only a single handle adapted to be gripped by both of the player's hands. Numerous other modifications will also suggest themselves to those of skill in the art. Accordingly, it is intended that the scope of the invention be limited only by the claims which follow.

I claim:

1. Sport apparatus comprising:

an elongate, flexible, generally inelastic pulling line having opposite terminal portions and a mid-portion interconnecting said terminal portions;

and a plurality of handle assemblies secured to each of said terminal portions respectively and longitudinally spaced thereon, each of said handle assemblies comprising at least two separate handle bodies attached to said pulling line at approximately the same location along the length thereof and both extending generally laterally outwardly from said pulling line and on generally the same side of said pulling line.

2. The apparatus of claim 1 wherein the handle assemblies of each of said terminal portions include a plurality of longitudinally spaced inner handle assemblies disposed distal the free end of said terminal portion.

3. The apparatus of claim 2 wherein adjacent ones of said inner handle assemblies of each of said terminal portions are secured to said pulling line at opposite lateral edges thereof.

4. The apparatus of claim 3 further including a pair of end handle assemblies secured to said pulling line at the respective free end edges of said terminal portions.

5. The apparatus of claim 4 further comprising a plurality of longitudinally spaced first connection means on said pulling line each mounting a respective one of said handle assemblies, said first connector means including side connectors adjacent the lateral edges of said pulling line and mounting respective ones of said inner handle assemblies and end connectors adjacent the end edges of said pulling line and mounting respective ones of said end handle assemblies.

6. The apparatus of claim 5 further including extension means comprising elongate, flexible, generally inelastic auxiliary line means having attachment means at one end thereof for releasably connecting said auxiliary line means to said end connectors, and auxiliary handle means secured to said auxiliary line means.

7. The apparatus of claim 1 further comprising a plurality of first connection means on said pulling line each mounting a respective one of said handle assemblies, and wherein each of said handle assemblies includes a respective second connection means carried by each of said handle bodies for releasably securing said handle body to the respective first connection means of said pulling line.

8. The apparatus of claim 7 wherein said connection means is operative to independently releasably secure said two handle bodies of each of said handle assemblies to said pulling line.

9. The apparatus of claim 8 wherein said connection means are operative to permit independent swinging movement of said handle bodies with respect to said pulling line.

10. The apparatus of claim 9 wherein said connection means include swivel mechanisms operative to permit independent swivelling of said handle bodies with respect to said pulling line.

11. The apparatus of claim 10 wherein each of said handle bodies includes a loop of flexible, generally inelastic material.

12. The apparatus of claim 1 wherein each of said handle assemblies includes at least one handle body comprising a loop of flexible, generally inelastic material.

13. The apparatus of claim 12 wherein said pulling line and said handle bodies are comprised of woven nylon fabric.

* * * * *